US005265534A

United States Patent [19]

Hamu

[11] Patent Number: 5,265,534

[45] Date of Patent: Nov. 30, 1993

[54] SCREEN ROLLER PRINTING FRAME IMPROVEMENTS

[76] Inventor: Kaino J. Hamu, 16061 Dominica Cir., Huntington Beach, Calif. 92649

[21] Appl. No.: 35,409

[22] Filed: Mar. 23, 1993

[51] Int. Cl.[5] ..... B05C 17/08

[52] U.S. Cl. ..... 101/127.1; 38/102.91

[58] Field of Search ..... 101/127.1, 128, 128.1, 101/415.1; 38/102-102.9, 102.91; 69/19.1, 19.3; 160/378, 395, 397

[56] References Cited

U.S. PATENT DOCUMENTS

| | | | |
|---|---|---|---|
| 3,601,912 | 8/1971 | Dubbs | 38/102.91 |
| 3,908,293 | 9/1975 | Newman | 101/127.1 |
| 4,409,749 | 10/1983 | Hamu | 160/378 |
| 5,018,442 | 5/1991 | Hamu | 38/102.91 |
| 5,127,176 | 7/1992 | Newman | 38/102.1 |
| 5,163,367 | 11/1992 | Newman | 101/127.1 |

*Primary Examiner*—Edgar S. Burr
*Assistant Examiner*—Ren Yan
*Attorney, Agent, or Firm*—Boniard I. Brown

[57] ABSTRACT

A silk screen printing frame having screen tensioning rollers which are rotatable to stretch a printing screen edgewise across the frame and are mounted on the frame by improved roller mounting assemblies that secure the rollers to roller mounting members at the roller ends. Each roller mounting assembly has an end block portion fixed within the adjacent roller end, a wrench engaging portion beyond the roller end by which the roller may be turned and which may be integral with or a separate part from the end block portion, a bolt extending axially through the end block and wrench engaging portions and the adjacent roller mounting member, and a lock nut threaded on the outer end of the bolt for releasably securing the roller against turning. A head on the inner end of the bolt engages the inner side of the end block portion to restrain the bolt against being pulled outwardly through the assembly when the lock nut is tightened to secure the roller against turning.

37 Claims, 2 Drawing Sheets

SCREEN ROLLER PRINTING FRAME IMPROVEMENTS

BACKGROUND OF THE INVENTION

1. FIELD OF THE INVENTION

This invention relates generally to the silk screen printing art and more particularly to a novel printing screen stretch frame.

2. PRIOR ART

Simply stated, a printing screen stretch frame comprises a rectangular frame structure having a central rectangular opening and screen tensioning means along the sides of the frame opening for gripping edges of printing screen placed across one side of the frame and stretching the screen edgewise. One type of printing screen frame has screen tensioning draw bars which are movable laterally in the plane of the frame to stretch and release the printing screen. Another type of screen frame, referred to herein in places as a roller frame, has screen tensioning rollers which are rotatable to stretch and release the screen.

Two basic types of roller frames are known in the art. One type comprises four rigid frame members arranged along the four sides of a rectangle and joined end to end at the corners of the rectangle to form a rigid rectangular frame part and screen rollers rotatably mounted on the frame members. The other basic type of roller frame lacks such a rigid frame part and includes only corner brackets at the four corners of the frame, screen rollers extending along the four sides of the frame between the adjacent corner brackets, and roller mounting means securing the rollers to the corner brackets. This latter type of screen frame comprises only the corner brackets, rollers, and roller mounting means and is rigidized by rigidly securing the rollers to the brackets. The present invention is concerned with roller screen frames of this latter kind.

A number of roller screen frames with and without separate rigid frame members have been devised. Among these known frames are those illustrated in FIGS. 5–7 of the attached drawings and those described in the patents listed below.

The roller frame illustrated in FIGS. 5–7 of the attached drawings includes screen rollers 20 attached to corner brackets 22 by bolts 24 having outer heads 26 which are accessible for tightening and releasing the bolts and threaded shanks 28 which extend inwardly through the corner brackets, wrench heads 30 for turning the rollers, and end blocks 32 fixed within the roller ends into threaded engagement with nuts 34 fixed within the end blocks.

U.S. Pat. No. 3,601,912 dated Aug. 31, 1978, to Dubbs discloses a screen frame having screen rollers 14, 16 joined by corner brackets 18.

U.S. Pat. No. 3,908,293 dated Sep. 30, 1975 to Newman discloses a screen frame having screen rollers 18, 20 extending between corner brackets 26. Secured within the roller ends are end blocks 58 having integral wrench heads 86 for turning the rollers and integral threaded studs 72 which extend through the corner brackets into threaded engagement with outer lock nuts 84 for securing the rollers against rotation.

U.S. Pat. No. 4,430,814 dated Feb. 14, 1984, to Wulc discloses a screen frame having screen rollers 16, 18 extending between corner brackets 24 and secured to the brackets by threaded studs 34 which are press fitted within the roller ends and mount inner nuts 36 for turning the rollers and outer nuts 40 for securing the rollers against rotation.

U.S. Pat. No. 5,018,442 dated May 28, 1991, to Hamu discloses a screen frame having screen rollers 16 extending between corner brackets 14. Threaded studs 34, **34*a* are press fitted (FIG. 2) or threaded (FIG. 5) in end blocks 28, 28*a* fixed within the roller ends and mount inner nuts 38 for turning the rollers and outer nuts 40, 40*a*** for securing the rollers against rotation.

The screen frames referred to above and other existing screen frames have certain deficiencies which this invention overcomes. The frame arrangement of FIGS. 5–7, for example, requires complex and costly machining of the end blocks 32 to fixedly receive the nuts 34. In the Dubbs, Hamu, and Wulc patents, tightening the lock nuts on the studs to secure the rollers against turning exerts substantial stress on the press-fitted or threaded joints between the studs and the rollers. In order to prevent their failure by rupture of the press-fitted joints and stripping of the threaded joints, the joints must have a relatively long axial length sufficient to resist such rupture or stripping. This, in turn, increases the mass of metal in and thereby the weight and cost of the rollers. Also, the threaded joints require internal threading of the end blocks and increases the frame cost. The use of cross bolts in Newman to secure the end blocks in the rollers requires machining of the rollers which increases the roller cost and renders the rollers prone to fluid leakage around the bolts into the rollers.

SUMMARY OF THE INVENTION

This invention provides an improved roller screen frame and an improved roller mounting means for the frame. The improved roller screen frame comprises a rectangular frame structure having a central rectangular opening and composed of tubular screen tensioning rollers along the sides of the opening, roller mounting members at the four corners of the frame opposite the adjacent roller ends, and improved roller mounting assemblies according to the invention securing the roller ends to the adjacent mounting members. Each roller has a longitudinal rotation axis and means for gripping an edge a printing screen placed across one side of the frame and is rotatable in one direction on its rotation axis to wind the screen on the roller and thereby stretch the screen across the frame.

The improved roller mounting assembly of the invention includes an end block portion fixed within the adjacent roller end, a wrench engaging portion between the roller end and the adjacent roller mounting member, and a bolt. This bolt has a shank extending along the roller axis through the end block portion, the wrench engaging portion, and the adjacent roller mounting member, and a lock nut threaded on the outer end of the shank at the outer side of the mounting member.

Each roller is rotatable in one direction by engagement of wrenches with the the wrench engaging portions of the roller mounting assemblies to stretch the printing screen across the frame. The roller lock nuts are rotatable into and from engagement with the adjacent roller mounting members to releasably secure the rollers against turning in the opposite direction and thereby retain the stretched screen in its taut condition.

According to one feature of the invention, the bolt of each roller mounting assembly has a shoulder at its inner end which engages the inner side of the end block portion to positively restrain the bolt against outward endwise movement through the block portion when the outer lock nut is tightened against the roller mounting member to secure the roller against turning. This shoulder carries the entire axial load exerted on the bolt when its outer lock nut is tightened. As a consequence, the joint failure and thread stripping problems referred to earlier in connection with prior roller mounting arrangements are avoided and the axial length of the end block portion within the roller may be substantially reduced without risk of failure of the joint between the bolt and end block.

According to another feature of the invention, the bolt of each roller mounting assembly is pressed axially through, rather than threaded in, its respective end block portion. This eliminates the need of internally threading the end block portion. Relative rotation of the bolt and end block portion is prevented by engaging formations on the bolt and block portion. According to the preferred practice of the invention, for example, the bolt is made of a harder material than the end block portion, and its shank is formed with axial serrations or ridges which bite or cut into the softer end block material when the bolt is pressed through the block portion to prevent turning of the bolt in the end block portion.

In two presently preferred embodiments described herein, the end block portion and wrench engaging portion of each roller mounting assembly are separate parts. The bolts of these preferred assemblies are pressed through the separate end blocks in the manner mentioned above. In one of these two embodiments, the separate wrench engaging part is a roller turning nut which is threaded on the bolt in the manner explained in my earlier mentioned U.S. Pat. No. 5,018,442. Rotation of the nut in the direction in which the roller turns to stretch the printing screen jams the nut against the end of the roller so that further rotation of the nut in this direction rotates the roller to stretch the printing screen. In the other of these two preferred embodiments, the bolt is pressed through both the end block part and the separate wrench engaging part. In a third presently preferred embodiment, the end block and wrench engaging portions of the roller mounting assembly are integrally formed as a single unitary part through which the bolt is pressed.

DESCRIPTION OF THE PREFERRED EMBODIMENT

Figure 1:
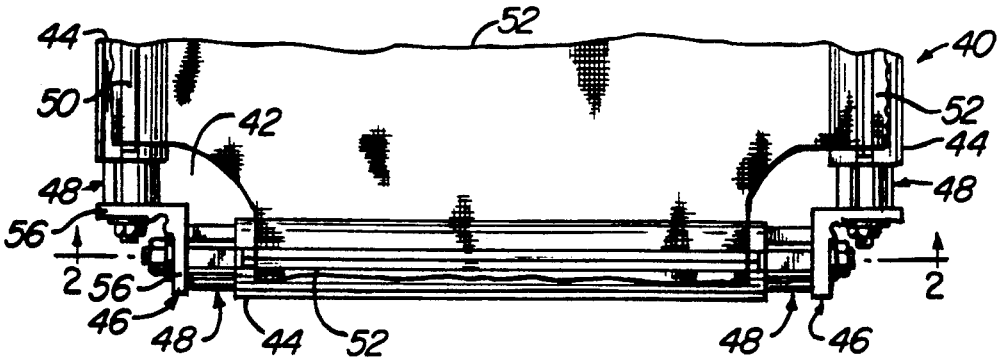
FIG. 1 is a fragmentary side view of an improved roller screen printing frame according to this invention mounting a printing screen.
Figure 2:
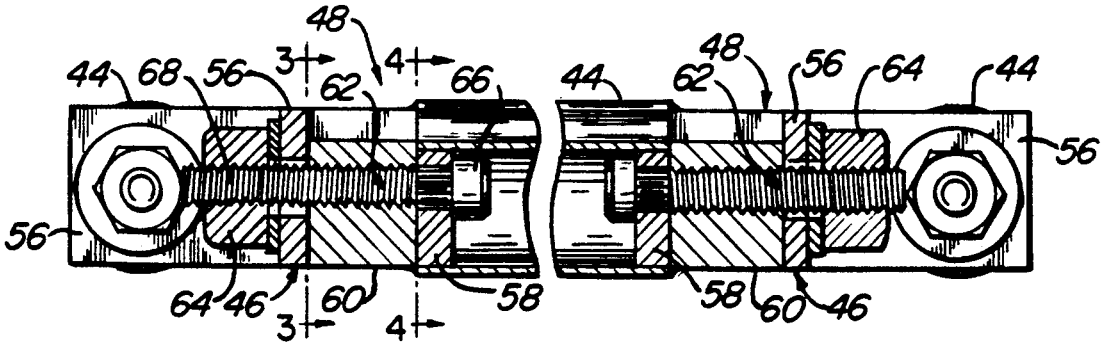
FIG. 2 is an enlarged section taken on line 2—2 in FIG. 1 with the printing screen omitted for the sake of clarity.
Figure 3:
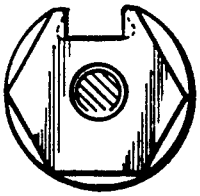
FIG. 3 is a section taken on line 3—3 in FIG. 2.

Turning now to these drawings and first to FIGS. 1–4, the illustrated roller screen printing frame 40 comprises a rectangular frame structure (only one full side and two partial sides of the frame structure shown) having a central rectangular opening 42, screen tensioning rollers 44 along the four sides (only three sides shown) of the opening, roller mounting members 46 at the frame corners between the adjacent roller ends, and improved roller mounting means 48 according to the invention securing the rollers to the mounting members. The screen rollers 44 have screen gripping means 50 like those shown in my above mentioned U.S. Pat. No. 5,018,442. In use, a printing screen 52 is placed across one side of the frame. The screen edges are attached to the screen gripping means 50, and the rollers are rotated in directions to wind the screen on the rollers and thereby stretch the screen edgewise across the frame. During screen printing, the frame is positioned with the screen side of the frame lowermost and with the printing screen in contact with the work to be printed.

Figure 4:
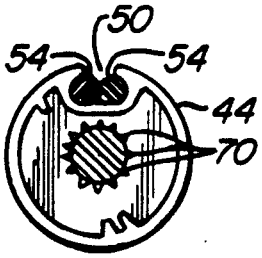
FIG. 4 is a section taken on line 4—4 in FIG. 2.

Except for the roller mounting means 48, the roller frame 40 is conventional. That is to say, the frame rollers 44 and roller mounting members 46 are conventional and thus need be described only in sufficient detail to enable a full and complete understanding of the invention. With this in mind, each screen roller 44 comprises a tube having the cross-sectional configuration shown in FIG. 4. Along the top of the roller in FIG. 4 is a channel receiving a pair of screen gripping rods 54 to form the screen gripping means 50. Each roller mounting member 46 is an L-shaped bracket like that shown in my U.S. Pat. No. 5,018,442 and having a pair of right-angle bracket arms 56 extending across the ends of the adjacent rollers 44 normal to their rotation axes.

Each end of each roller 44 is secured to the adjacent mounting member 46 by a roller mounting means 48 of this invention. Each roller mounting means comprises a mounting assembly including a roller end block portion 58, a wrench engaging portion 60, a bolt 62, and a lock nut 64. The end block portion 58 of each roller mounting assembly is shaped to complement the internal cross-section of its roller and is adhesively bonded, welded, or otherwise rigidly fixed within the adjacent roller end. The wrench engaging portion 60 is coaxially disposed beyond the end of the roller. The mounting assembly bolt 62 has a head 66 at the inner side of the end block portion 58 and a shank 68 which extends along the rotation axis of the roller 44 through the end block portion 62, the wrench engaging portion 60, and the adjacent arm 56 of the adjacent roller mounting bracket 46. The lock nut 64 is threaded on the outer end of the bolt shank at the outer side of the bracket arm.

In the particular inventive embodiment illustrated in FIGS. 1–4, the end block portion 58 and wrench engaging portion 60 of each roller mounting assembly 48 are separately formed parts. The end block 60 has an annular generally disc-like shape and is disposed in a plane transverse to the rotation axis of its roller 44. The head 66 of the assembly bolt 62 seats against the inner side of the block. The bolt shank 68 has an inner unthreaded portion adjacent the head 66 which is press fitted within a central hole in the end block. According to one feature of the invention, the end block 58 and the bolt 62 have engaging formations 70 which secure the bolt against rotation relative to the end block. In the preferred embodiment illustrated, the engaging formations 70 include longitudinal spline-like serations or ridges which are circumferentially spaced about the bolt shank 68 within the end block. The bolt is made of a harder material than the end block so that when the bolt is pressed axially through the block, the ridges 70 cut into the material of the block to firmly fix bolt against turning in the block. The engaging formations 70 could be a polygonal portion of the bolt engaging in a mating polygonal opening in the end block.

In the embodiment of FIGS. 1–4, the wrench engaging portion or part 60 of each roller mounting assembly 48 is a hexagonal roller nut. This roller nut is threaded on the shank 68 of the assembly bolt 62 in the manner described in my U.S. Pat. No. 5,018,442, such that rotation of the nut on the bolt in the direction in which the respective roller 44 turns to stretch the printing screen 52, jams the nut against the end of the roller. This prevents further rotation of the nut in this direction relative to the roller. Accordingly, the rollers 44 may be rotated to stretch the printing screen 52 across the frame 40 by turning the roller nuts 60 with wrenches. The rollers are secured against reverse rotation to retain the stretched screen in its taut condition by threading the lock nuts 64 tightly against the adjacent mounting bracket arms 56 to firmly grip these arms between the lock nuts and the roller nuts 60.

Figure 8:
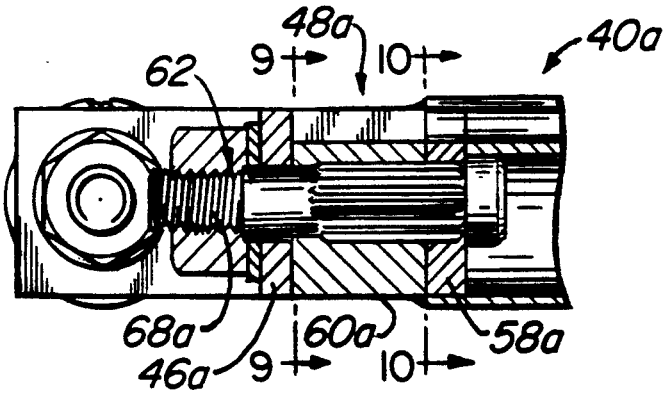
FIG. 8 is a fragmentary section through a modified roller screen printing frame according to this invention.
Figure 9:
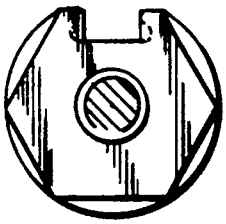
FIG. 9 is a section taken on line 7—7 in FIG. 8.
Figure 10:
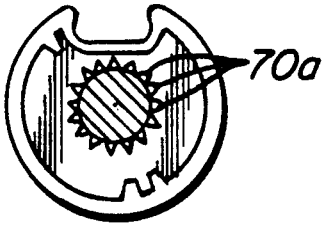
FIG. 10 is a section taken on line 7—7 in FIG. 8.

The modified screen printing frame 40*a* of FIGS. 8–10 is identical to the frame 40 just described except for the following differences between the roller mounting assemblies 48*a* of the modified frame and those of the frame 40. The wrench engaging portion or part 60*a* of each roller mounting assembly 48*a* is not a nut threaded on the assembly bolt 62*a* as in the frame 40, but rather a member of hexagonal nut-like shape having a central hole. The bolt shank 68*a* has a relatively long unthreaded portion which is pressed through, and has ridges 70*a* which extend through, both the end block 58*a* and the wrench engaging member 60*a* to secure the bolt against turning relative to the block and member.

Figure 11:
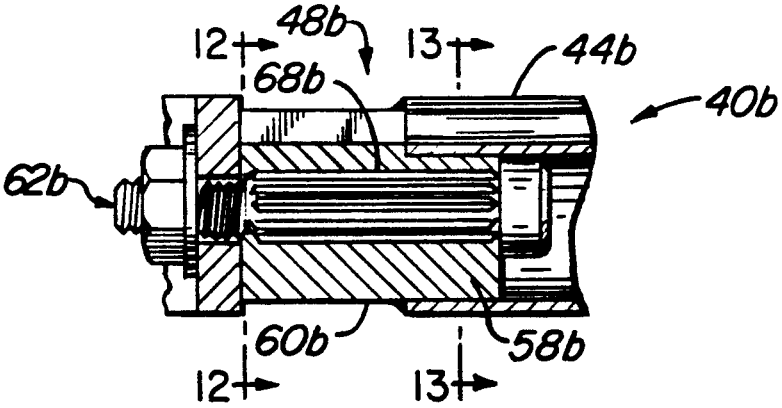
FIG. 11 is a fragmentary section through a further modified roller screen printing frame according to this invention.
Figure 12:
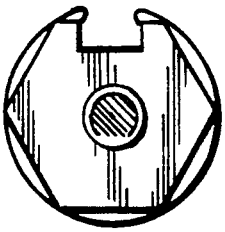
FIG. 12 is a section taken on line 7—7 in FIG. 11.
Figure 13:
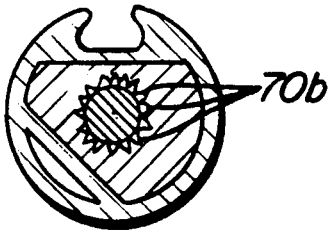
FIG. 13 is a section taken on line 7—7 in FIG. 11.

The modified screen printing frame 40*b* of FIGS. 11–13 is identical to the frame 40 first described except for the following differences between the roller mounting assemblies 48*b* of the modified frame and those of the frame 40. The end block portion 58*b* and wrench engaging portion 60*b* of each roller mounting assembly 48*b* are not formed as separate parts as in the frame 40, but rather as a single integral part. This integral part has an inner end portion which is fixed within the respective roller and forms the end block portion 58*b* of the mounting assembly and an outer end of hexagonal cross-section which forms the wrench engaging portion 60*b* of the mounting assembly. The shank 68*b* of the assembly bolt 62*b* has a relatively long unthreaded portion which is pressed through, and has ridges 70*b* which extend through, both the end block and wrench engaging portions of the integral part to secure the bolt against turning relative to the part.

The modified screen printing frames of FIGS. 8–13 are otherwise identical to and used in the same way as the frame of FIGS. 1–4. If desired, the wrench engaging portions of the roller mounting assemblies may be welded to the adjacent roller ends about the full circumference of the rollers, as shown, to seal the ends of the rollers against liquid leakage into the rollers. In the case of FIGS. 1–4, the weld between the wrench engaging portions or nuts and the rollers may be omitted to permit removal of the nuts. These nuts may be constructed of a harder material than the rollers to permit the nuts to be jammed against the rollers with sufficient force to form a seal between the nuts and rollers.

Figure 5:
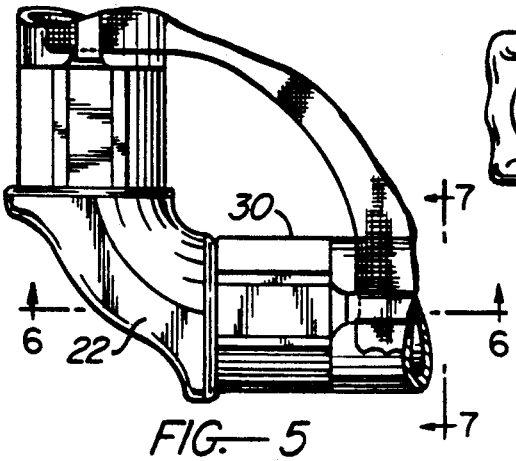
FIG.—5 (PRIOR ART)
FIG. 5 is a fragmentary view of an existing roller screen frame.
Figure 6:
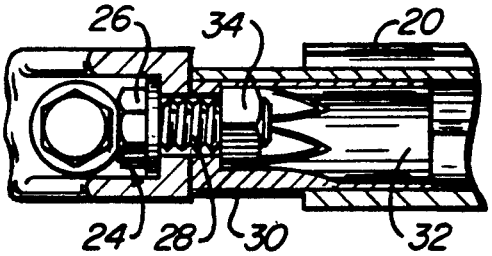
FIG.—6 (PRIOR ART)
FIG. 6 is a section taken on line 6—6 in FIG. 5.
Figure 7:
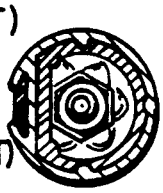
FIG.—7 (PRIOR ART)
FIG. 7 is a section taken on line 7—7 in FIG. 5.

The improved screen printing frames and roller mounting assemblies of the invention have the following important features. Engagement of the heads of the roller mounting assembly bolts with the assembly end blocks eliminates the need for threaded or press fit joints to support the axial loads exerted on the bolts when the outer lock nuts are tightened to secure the screen rollers against rotation. As noted earlier, these joints are prone to failure by rupture or stripping when the bolts are axially stressed by tightening the lock nuts. The bolt holes in the end blocks need not be internally threaded, which results in a cost saving. Another advantage of locating the bolt heads within the rollers for engagement with the end blocks is the elimination of the cost of internally shaping the end blocks to fixedly receive nuts, as in the prior art screen frame arrangement of FIGS. 5–7. The improved screen frames of the invention are thus characterized by relative simplicity of construction and reduced cost of manufacture.

I claim:

1. A printing screen stretch frame, comprising:

a rectangular frame structure having a central rectangular opening and including a pair of tubular screen tensioning rollers along two opposite sides, respectively, of the opening, a roller mounting member at each end of each roller having an inner side adjacent the respective roller and an opposite outer side, and roller mounting means mounting each end of each roller on the adjacent mounting member, and wherein said frame is adapted to receive a printing screen across one side of the frame, each roller has a central longitudinal rotation axis and means for gripping an edge the printing screen, and each roller is rotatable in one direction on its rotation axis to wind the screen on the roller, each roller mounting means comprises an end block portion fixed within the adjacent roller end and having an inner side facing the opposite roller end, a wrench engaging portion disposed between the adjacent roller end and the adjacent mounting member and secured against rotation in said one direction relative to the respective roller, a bolt extending along the roller axis through said end block portion, said wrench engaging portion, and the adjacent mounting member and secured against rotation relative to said end block portion, each bolt includes an inner shoulder engaging the inner side of its adjacent end block portion to prevent outward axial movement of the bolt relative to the end block portion and roller, and an outer threaded end extending beyond the outer side of the adjacent mounting member, each roller mounting means further includes a lock nut threaded on said threaded end of said bolt at the outer side of the adjacent mounting member, and said rollers are rotatable in said one direction by said wrench engaging portions to stretch the printing screen across the frame, and said lock nuts are rotatable on their bolts into and from engagement with the adjacent mounting members to secure said rollers against and release the rollers for rotation.

2. A stretch frame according to claim 1, wherein:

said wrench engaging portions are welded to the adjacent roller ends about the entire circumference of the rollers.

3. A stretch frame according to claim 1, wherein:

at least one of said portions of each roller mounting means is welded to the respective bolt.

4. A stretch frame according to claim 1, wherein:

said bolt and end block portion of each roller mounting means have engaging formations which secure the bolt against rotation relative to the respective end block portion.

5. A stretch frame according to claim 1, wherein:

said wrench engaging portion and said end block portion of each roller mounting means are separately formed parts.

6. A stretch frame according to claim 1, wherein:

said wrench engaging portion and said end block portion of each roller mounting means are separately formed parts, each wrench engaging portion comprises a roller turning nut, and the roller turning nut and bolt of each roller mounting means have mating threads which advance the roller turning nut toward the adjacent roller end during relative rotation of the respective roller turning nut in said one direction relative to the respective bolt, whereby the roller turning nuts on each roller are rotatable to positions against the adjacent roller ends wherein the latter nuts are secured against rotation in said one direction relative to the the respective roller and may be used to rotate the respective roller in said one direction.

7. A stretch frame according to claim 6, wherein:

each roller turning nut is constructed of a harder material than its roller and may be tightened against the adjacent roller end sufficiently to form a liquid-tight seal between the nut and roller.

8. A stretch frame according to claim 6, wherein:

each wrench engaging portion is welded to the adjacent roller end about the entire circumference of the rollers.

9. A screen frame according to claim 6 wherein:

each bolt comprises a harder material than and has a press fit in the respective end block and wrench engaging portions, and each bolt has longitudinal ridges which bite into the respective end block and wrench engaging portions to secure the bolt and end block portions against relative rotation.

10. A stretch frame according to claim 1, wherein:

said wrench engaging portion and said end block portion of each roller mounting means are separately formed parts, said end block portion and bolt of each roller mounting means have engaging formations which secure the respective end block portion and bolt against relative rotation, and said wrench engaging portion and bolt of each roller mounting means have engaging formations which secure the respective wrench engaging portion and bolt against relative rotation.

11. A stretch frame according to claim 1, wherein:

said wrench engaging portion and said end block portion of each roller mounting means are integrally joined to form a single unitary part.

12. A screen frame according to claim 11 wherein:

each bolt comprises a harder material than and has a press fit in the respective unitary part, and each bolt has longitudinal ridges which bite into the respective unitary part to secure the bolt and part against relative rotation.

13. A stretch frame according to claim 1, wherein:

said wrench engaging portion and said end block portion of each roller mounting means are integrally joined to form a single unitary part, and said unitary part and said bolt of each roller mounting means have engaging formations which secure the respective unitary part and bolt against relative rotation.

14. A stretch frame according to claim 13, wherein:

each unitary part is welded to the adjacent roller end about the entire circumference of the rollers.

15. A screen frame according to claim 1 wherein:

each bolt comprises a harder material than and has a press fit in the respective end block portion, and each bolt has longitudinal ridges which bite into the respective end block portion to secure the bolt and end block portion against relative rotation.

16. A screen tensioning roller assembly for a printing screen roller assembly, comprising:

a cylindrical roller having means for gripping an edge of a printing screen and a central rotation axis on which the roller is rotatable in one direction to wind the screen on the roller, roller mounting means at each end of the roller including an end block portion fixed within the adjacent roller end and having an inner side facing the opposite roller end, a wrench engaging portion beyond the adjacent roller end and secured against rotation in said one direction relative to the roller, a bolt extending along the roller axis through said end block portion and said wrench engaging portion and secured against rotation relative to said end block portion, and wherein each bolt includes an inner shoulder engaging the inner side of its adjacent end block portion to prevent outward axial movement of the bolt relative to the adjacent end block portion and roller, and an outer threaded end extending beyond said wrench engaging portion, and each roller mounting means further includes a lock nut threaded on said threaded end of the respective bolt.

17. A roller assembly according to claim 16, wherein:

said wrench engaging portion of each roller mounting means is welded to the adjacent roller end about the entire circumference of the rollers.

18. A roller assembly according to claim 16, wherein:

at least one of said portions of each roller mounting means is welded to the respective bolt.

19. A roller assembly according to claim 16, wherein:

said bolt and end block portion of each roller mounting means have engaging formations which secure the bolt against rotation relative to the respective end block portion.

20. A roller assembly according to claim 16, wherein:

said wrench engaging portion and said end block portion of each roller mounting means are separately formed parts.

21. A roller assembly according to claim 16, wherein:

said wrench engaging portion and said end block portion of each roller mounting means are separately formed parts, each wrench engaging portion comprises a roller turning nut, and the roller turning nut and bolt of each roller mounting means have mating threads which advance the roller turning nut toward the adjacent roller end during relative rotation of the respective roller turning nut in said one direction relative to the respective roller, whereby the roller turning nuts are rotatable to positions against the adjacent roller ends wherein the latter nuts are secured against rotation in said one direction relative to the the roller and may be used to rotate the roller in said one direction.

22. A roller assembly according to claim 21, wherein:

each roller turning nut is constructed of a harder material than the roller and may be tightened against the adjacent roller end sufficiently to form a liquid-tight seal between the nut and roller.

23. A roller assembly according to claim 21, wherein:

each wrench engaging portion is welded to the adjacent roller end about the entire circumference of the roller.

24. A screen frame according to claim 21 wherein:

each bolt comprises a harder material than and has a press fit in the respective end block and wrench engaging portions, and each bolt has longitudinal ridges which bite into the respective end block and wrench engaging portions to secure the bolt and said end block and wrench engaging portions against relative rotation.

25. A roller assembly according to claim 16, wherein:

said wrench engaging portion and said end block portion of each roller mounting means are separately formed parts, said end block portion and bolt of each roller mounting means have engaging formations which secure the respective end block portion and bolt against relative rotation, and said wrench engaging portion and bolt of each roller mounting means have engaging formations which secure the respective wrench engaging portion and bolt against relative rotation.

26. A roller assembly according to claim 16, wherein:

said wrench engaging portion and said end block portion of each roller mounting means are integrally joined to form a single unitary part.

27. A screen frame according to claim 26, wherein:

each bolt comprises a harder material than and has a press fit in the respective unitary part, and each bolt has longitudinal ridges which bite into the respective unitary part to secure the bolt and part against relative rotation.

28. A roller assembly according to claim 16, wherein:

said wrench engaging portion and said end block portion of each roller mounting means are integrally joined to form a single unitary part, and said unitary part and said bolt of each roller mounting means have engaging formations which secure the respective unitary part and bolt against relative rotation.

29. A roller assembly according to claim 28, wherein:

each unitary part is welded to the adjacent roller end about the entire circumference of the roller.

30. A roller assembly according to claim 16 wherein:

each bolt comprises a harder material than and has a press fit in the respective end block portion, and each bolt has longitudinal ridges which bite into the respective end block portion to secure the bolt and end block portion against relative rotation.

31. For use in a screen printing frame having a rectangular opening and pair of tubular screen tensioning rollers along at least two opposite sides, respectively, of the opening, and a roller mounting member at each end of each roller having an inner side adjacent the respective roller and an opposite outer side, roller mounting means for mounting each end of each roller on the adjacent mounting member, comprising:

a wrench engaging portion having a rotation axis, an end block portion at one side of and coaxial with said wrench engaging portion and adapted to be fixed within one end of a roller, a bolt extending along said axis through said end block portion and said wrench engaging portion and secured against rotation relative to said end block portion, and wherein said end block portion has a normally inner side opposite said wrench engaging portion, and said wrench engaging portion has a normally outer side opposite said end block portion, said bolt includes an inner shoulder engaging the inner side of said end block portion to prevent outward axial movement of the bolt relative to the end block portion, and an outer threaded end extending beyond the outer side of said wrench engaging portion, and said roller mounting means further includes a lock nut threaded on said threaded end of said bolt.

32. Roller mounting means according to claim 31, wherein:

said wrench engaging portion and said end block portion are separately formed parts, and said wrench engaging portion comprises a roller turning nut threaded on said bolt.

33. Roller mounting means according to claim 31, wherein:

said wrench engaging portion and said end block portion are separately formed parts, said end block portion and bolt have engaging formations which secure the end block portion and bolt against relative rotation, and said wrench engaging portion and bolt have engaging formations which secure the wrench engaging portion and bolt against relative rotation.

34. Roller mounting means according to claim 31, wherein:

said wrench engaging portion and said end block portion are integrally joined to form a single unitary part, and said unitary part and said bolt have engaging formations which secure the unitary part and bolt against relative rotation.

35. Roller mounting means according to claim 31, wherein:

each bolt comprises a harder material than and has a press fit in the end block portion, and said bolt has longitudinal ridges which bite into the end block portion to secure the bolt and end block portion against relative rotation.

36. Roller mounting means according to claim 31, wherein:

said wrench engaging portion and said end block portion are separately formed parts, said bolt comprises a harder material than and has a press fit in the end block and wrench engaging portions, and said bolt has longitudinal ridges which bite into the end block and wrench engaging portions to secure the bolt and end block portions against relative rotation.

37. Roller mounting means according to claim 31, wherein:

said wrench engaging portion and said end block portion are integrally joined to form a single unitary part, said bolt comprises a harder material than and has a press fit in said unitary part, and said bolt has longitudinal ridges which bite into the unitary part to secure the bolt and part against relative rotation.

* * * * *